US007012186B2

(12) United States Patent
Jung et al.

(10) Patent No.: US 7,012,186 B2
(45) Date of Patent: Mar. 14, 2006

(54) 2-PHASE PITCH DETECTION METHOD AND APPARATUS

(75) Inventors: Doill Jung, Seoul (KR); Hunseok Seo, Seoul (KR)

(73) Assignee: Amusetec Co., Ltd., (KR)

( * ) Notice: Subject to any disclaimer, the term of this patent is extended or adjusted under 35 U.S.C. 154(b) by 139 days.

(21) Appl. No.: 10/485,001

(22) PCT Filed: Jul. 26, 2002

(86) PCT No.: PCT/KR02/01423

§ 371 (c)(1),
(2), (4) Date: Jan. 26, 2004

(87) PCT Pub. No.: WO03/017250

PCT Pub. Date: Feb. 27, 2003

(65) Prior Publication Data

US 2004/0159220 A1 Aug. 19, 2004

(30) Foreign Application Priority Data

Jul. 27, 2001 (KR) ..... 2001-45563

(51) Int. Cl.
*G10H 7/00* (2006.01)

(52) U.S. Cl. ..... 84/654

(58) Field of Classification Search ..... 84/616, 84/654

See application file for complete search history.

(56) References Cited

U.S. PATENT DOCUMENTS 5,619,004 A 4/1997 Dame ..... 811/616
6,124,544 A * 9/2000 Alexander et al. ..... 84/616
6,653,546 B1 * 11/2003 Jameson ..... 84/735
2004/0220802 A1 * 11/2004 Chang et al. ..... 704/207

FOREIGN PATENT DOCUMENTS

| | | |
|---|---|---|
| JP | 4-288600 | 10/1992 |
| JP | 9-212194 | 8/1997 |
| KR | 1999-0080416 | 11/1999 |

OTHER PUBLICATIONS

PCT International Search Report; International application No. PCT/KR02/01423; International filing date: Jul. 26, 2002; Date of Mailing: Oct. 21, 2002.

PCT International Preliminary Examination Report; International application No. PCT/KR02/01423; International filing date: Jul. 26, 2002; Date of Completion: Oct. 16, 2003.

* cited by examiner

*Primary Examiner*—Jeffrey W Donels
(74) *Attorney, Agent, or Firm*—Cantor Colburn LLP

(57) ABSTRACT

A pitch detection method and appartus are provided. The pitch detection method includes anlyzing an externally input digital signal into frequency components and detecting a pitch candidate based on the frequency components; comparing an error range for the pitch candidate with an error range, which is calculated using the error range or the result of performing autocorrelation on an autocorrelation range, which is calculated using the error range for the pitch candidate, permorming autocorrelation on the digital signal in a predetermined time range when the error range for the result of autocorrelation is less than or equal to the range for the pitch candidate; and determining a pitch within an intersection between a frequency range obtained using frequency analysis and a frequency range, in which an autocorrelation value is largest, as a final pitch. Accordingly, an error range for a pitch detection result is reduced by sequentially performing frequency analysis and autocorrelation with respect to an externally input digita

13 Claims, 6 Drawing Sheets

2-PHASE PITCH DETECTION METHOD AND APPARATUS

TECHNICAL FIELD

The present invention relates to a pitch detection method and apparatus, and more particularly, to a 2-phase pitch detection method and apparatus for reducing an error range for a pitch detection result by sequentially performing frequency analysis and autocorrelation with respect to an externally input digital signal.

BACKGROUND ART

Technology of detecting a pitch of a note performed by a musical instrument in real time or a pitch of a person's voice has been developed and researched in order to extract performance information data on the note of the musical instrument or the person's voice or to play real-time music in concert.

Methods usually used to detect a pitch include a method of analyzing a frequency of a digital signal of a performing note or voice; a method of calculating a peak or zero-crossing period of a waveform in order to calculate a period of repetitive wave; and a method using the autocorrelation of a waveform.

In the frequency analysis method, an error in a high-frequency band is the same as an error in a low-frequency band. However, when the frequency analysis method is used to detect a pitch of sound produced by a musical instrument, the probability of a pitch detection failure due to an error increases in the low-frequency band in which a frequency interval between pitches is narrower than in the high-frequency band. In the method using autocorrelation, an error is large in the high-frequency band due to the characteristics of calculation.

In the method of calculating a peak or zero-crossing period, it is difficult to accurately calculate a period due to, for example, noise, and thus the result of the method is inaccurate.

DISCLOSURE OF THE INVENTION

To solve the above-described problems, it is an object of the present invention to provide a 2-phase pitch detection method and apparatus for accurately detecting a pitch by performing frequency analysis on an externally input digital signal and then performing autocorrelation on the digital signal in a predetermined time range selected according to the result of frequency analysis.

To achieve the above object of the present invention, there is provided a 2-phase pitch detection method including a first step of analyzing an externally input digital signal into frequency components and detecting a first pitch candidate based on the frequency components; a second step of comparing an error range for the first pitch candidate with an error range for the result of performing autocorrelation on an autocorrelation range, which is calculated using the error range for the first pitch candidate; and a third step of performing autocorrelation on the digital signal in a predetermined time range when the error range for the result of autocorrelation is less than or equal to the error range for the first pitch candidate, thereby detecting a pitch.

There is also provided a 2-phase pitch detection apparatus including a frequency analyzer for analyzing an externally input digital signal into frequency components and detecting a first pitch candidate based on the frequency components; an error range comparator for comparing an error range for the first pitch candidate with an error range for the result of performing autocorrelation on an autocorrelation range, which is calculated using the error range for the first pitch candidate; an autocorrelation calculator for performing autocorrelation on the digital signal in a predetermined time range when the error range for the result of autocorrelation is less than or equal to the error range for the first pitch candidate in order to detecting a second pitch candidate; a pitch determiner for determining a pitch based on the error range for the first pitch candidate and an error range for the second pitch candidate; and a result output unit for outputting the pitch determined by the pitch determiner.

BEST MODE FOR CARRYING OUT THE INVENTION

Hereinafter, embodiments of a 2-phase pitch detection method and apparatus according to embodiments of the present invention will be described in detail with reference to the attached drawings.

Figure 1:
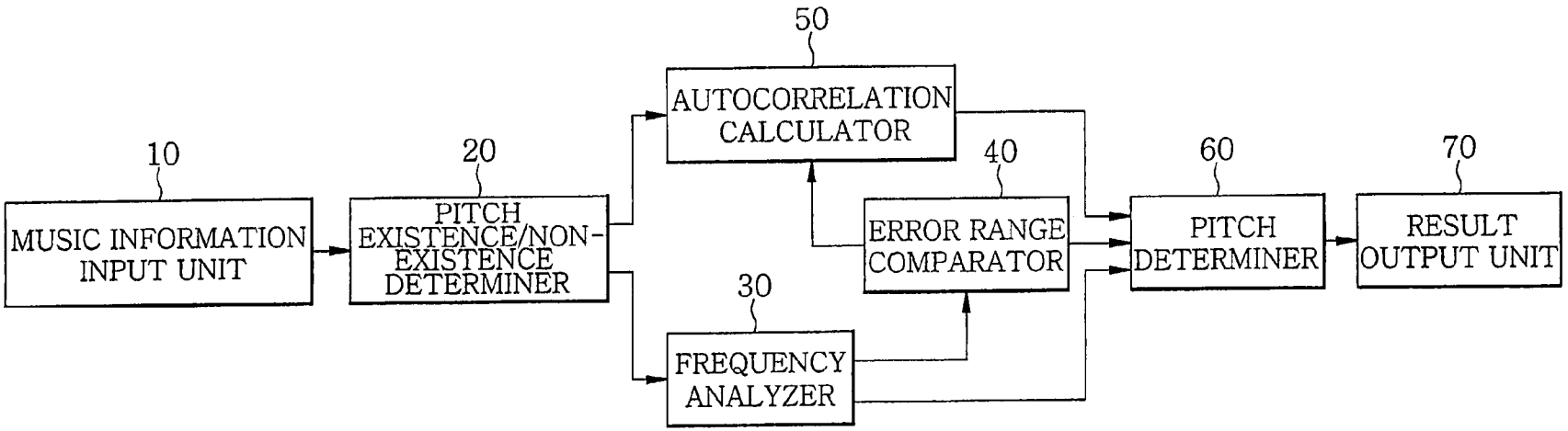
FIG. 1 is a schematic block diagram of a 2-phase pitch detection apparatus according to an embodiment of the present invention.

FIG. 1 is a schematic block diagram of a 2-phase pitch detection apparatus according to an embodiment of the present invention. Referring to FIG. 1, the 2-phase pitch detection apparatus includes a music information input unit 10, a pitch existence/non-existence determiner 20, a frequency analyzer 30, an error range comparator 40, an autocorrelation calculator 50, a pitch determiner 60, and a result output unit 70.

The music information input unit 10 converts an analog signal input through a microphone into a digital signal or receives a digital signal generated through conversion.

The pitch existence/non-existence determiner 20 senses the strength of a signal received through the music information input unit 10 to determine whether a pitch exists. In other words, when the sound pressure level of the signal received through the music information input unit 10 is higher than the sound pressure level of noise, which is predetermined taking into account a peripheral environment, it is considered that a signal of music sound is input.

The frequency analyzer 30 analyzes digital sound input through the pitch existence/non-existence determiner 20 into frequency components and detects a first pitch candidate based on the value of the frequency components. A method for detecting a pitch using frequency analysis is already known technology and can be performed in various ways. For example, in one aspect, after detecting the positions of peaks by analyzing frequency component values, an interval between the peaks is detected as a pitch candidate. In another aspect, the position of the maximum peak among a plurality of peaks is detected as a pitch candidate. In the meantime, to analyze digital sound into frequency components, Fast Fourier Transform (FFT) is usually used, but another method such as wavelet transform can be used.

The error range comparator 40 compares an error range R1 for the first pitch candidate detected by the frequency analyzer 30 with an error range R2 for the result of performing autocorrelation on an autocorrelation range L1 calculated using the error range R1. Here, the error range R1, the autocorrelation range L1, and the error range R2 are calculated in real time or calculated in advance and stored separately.

When the error range R2 for the autocorrelation result is less than or equal to the error range R1 for the first pitch candidate, the autocorrelation calculator 50 performs autocorrelation on the digital signal in a predetermined time range to detect a second pitch candidate. Here, the predetermined time range is determined in accordance with the autocorrelation range L1 calculated by the error range comparator 40. When the autocorrelation range L1 is used, it can be changed within a predetermined range. In other words, the autocorrelation range L1 can be changed according to the source of the digital signal (for example, the kind of musical instrument or a person's voice) and the usage of the digital signal.

After determining the autocorrelation range L1, the autocorrelation calculator 50 performs autocorrelation on the digital signal corresponding to the autocorrelation range L1 to detect a lag at which the autocorrelation coefficient is maximum and detects the second pitch candidate for the digital signal using the lag.

The pitch determiner 60 determines a pitch based on the error range R1 for the first pitch candidate and an error range R2 for the second pitch candidate. Here, the result of comparison performed by the error range comparator 40 is referred to. In other words, as the result of comparison performed by the error range comparator 40, if the error range R2 for the autocorrelation result is less than or equal to the error range R1 for the first pitch candidate, a pitch is determined within the error range R2 for the second pitch candidate. Otherwise, a pitch is determined within the error range R1 for the first pitch candidate. However, when the lag detected to detect the second pitch candidate has the maximum or minimum value of the autocorrelation range L1 calculated using the error range R1 of the first pitch candidate, a pitch is determined within an intersection between the error range R1 of the first pitch candidate and the error range R2 of the second pitch candidate.

The result output unit 70 outputs the pitch determined by the pitch determiner 60.

Figure 2:
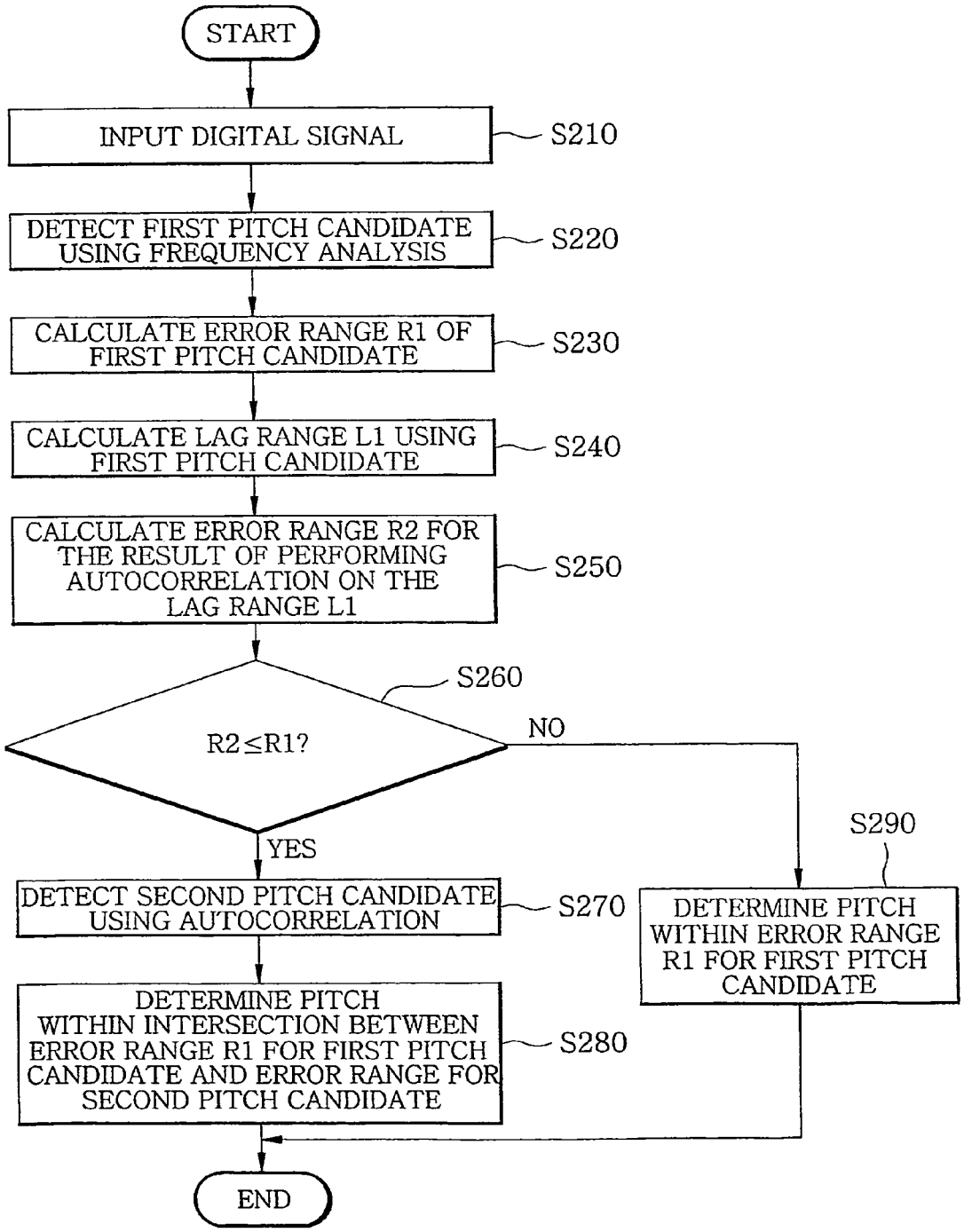
FIG. 2 is a flowchart of a 2-phase pitch detection method according to an embodiment of the present invention.

FIG. 2 is a flowchart of a 2-phase pitch detection method according to an embodiment of the present invention. The 2-phase pitch detection method according to the embodiment of the present invention will be described with reference to FIG. 2.

If a digital signal is externally input in step S210, the level of the digital signal is compared with the level of noise, which is predetermined taking into account a peripheral environment. When the level of the digital signal is higher than the predetermined level of noise, it is considered that a digital signal is input, and thus frequency analysis is performed on the input digital signal in order to detect a first pitch candidate in step S220. Already known techniques are used to detect a pitch candidate using frequency analysis and to perform frequency transform, and these techniques are explained in the description of the frequency analyzer 30. Thus, detailed description thereof will be omitted.

After the first pitch candidate is detected using frequency analysis, an error range R1 for the first pitch candidate is calculated in step S230. Next, an autocorrelation range (i.e., a lag range) L1 is calculated using the error range R1 in step S240. Next, an error range R2 for the result of performing autocorrelation on the autocorrelation range L1 is calculated in step S250. The error range R1, the autocorrelation range L1, and the error range R2 may be calculated in advance to the operation. In this case, steps S230 through S250 can be omitted.

The error range R1 for the first pitch candidate is compared with the error range R2 for the result of autocorrelation in step S260. If the error range R2 is less than or equal to the error range R1, autocorrelation is performed on the digital signal in a time range, which is determined in accordance with the autocorrelation range L1, to detect a second pitch candidate in step S270. Thereafter, a pitch is determined within an intersection between the error range R1 for the first pitch candidate and the error range R2 for the second pitch candidate in step S280. If the error range R2 is greater than the error range R1, the first pitch candidate detected using the frequency analysis is determined as a pitch in step S290.

Usually, it is not necessary to separately calculate the intersection between the error range R1 for the first pitch candidate and the error range R2 for the second pitch candidate. However, if a lag used to detect the second pitch candidate has the maximum or minimum value of the autocorrelation range (lag range) L1 calculated in step S240, the intersection between the error range R1 and the error range R2 for the second pitch candidate must be separately calculated.

As described above, according to the present invention, an accurate pitch can be detected by sequentially performing frequency analysis and autocorrelation on an input digital signal.

Hereinafter, a procedure for detecting a pitch on the condition that a sampling rate is 22,050 Hz and a window size for FFT is 1024 according to the present invention will be described with reference to Formulas.

First, when frequency analysis is performed on the above condition, a method of detecting a frequency from a frequency bin for the FFT (hereinafter, referred to as an FFT index) is defined as Formula (1). Here, the FFT index is determined in accordance with the window size for the FFT (hereinafter, referred to as an FFT window size). When the FFT window size is 1024, the FFT index is determined in a range of 1 through 1024.

$$FFT(F) = \frac{\text{Sampling rate}}{FFT\ \text{window size}} \times \frac{\text{Index} + (\text{Index} - 1)}{2} \tag{1}$$

Here, actual frequency range FR is determined according to Formula (2).

$$FR = \frac{\text{Sampling rate}}{FFT\ \text{window size}} \times (\text{Index} - 1) \sim \frac{\text{Sampling rate}}{FFT\ \text{window size}} \times (\text{Index}) \tag{2}$$

Accordingly, when the FFT index of a peak with respect to a basic frequency is 7 as the result of performing FFT analysis on a note C3 tuned on a piano, if the FFT index of 7 and the above-described condition are applied to Formulas (1) and (2), the frequency transformation result and actual frequency range with respect to the FFT index of 7, i.e., a seventh frequency bin, are calculated by Formula (3) and Formula (4), respectively.

That is, Formula (3) directs to the calculation of the frequency transformation result, and Formula (4) directs to the calculation of an error range for the frequency transformation result.

$$FFT(F) = \frac{22050}{1024} \times \frac{7+(7-1)}{2} = \frac{22050}{1024} \times 6.5 = 139.96 \text{ (Hz)} \quad (3)$$

$$FR_{FFT} = \frac{22050}{1024} \times (7-1) \sim \frac{22050}{1024} \times 7 = 129.19 \sim 150.73 \quad (4)$$

Accordingly, as the result of performing the FFT on a digital signal on the above condition, a first pitch candidate is 139.96 Hz(129.19~150.73), and the error range R1 for the first pitch candidate is 21.53 Hz((150.73–129.19)) based on the frequency range $FR_{FFT}$.

The autocorrelation range L1 can be calculated according to Formula (5) using the error range R1.

$$L1 = \frac{\text{Sampling rate}}{\text{Maximum frequency}} - \frac{\text{Sampling rate}}{\text{Minimum frequency}} \quad (5)$$

Here, the maximum frequency of the frequency range $FR_{FFT}$ is 150.73 Hz, and the minimum frequency of the frequency range $FR_{FFT}$ is 129.19. Accordingly, when these values are applied to Formula (5), the autocorrelation range L1 is calculated as shown in Formula (6).

$$L1 = \frac{22050}{150.73} \sim \frac{22050}{129.19} = 146.29 \sim 170.67 \approx 147 \sim 171 \quad (6)$$

In other words, the autocorrelation range L1 is 147~171.

In the meantime, the error range R2 for the result of autocorrelation changes in accordance with a lag. A frequency range $FR_{COR}$ detected using autocorrelation can be calculated according to Formula (7).

$$FR_{COR} = \frac{\text{Sampling rate}}{\text{Lag} - 0.5} \sim \frac{\text{Sampling rate}}{\text{Lag} + 0.5} \quad (7)$$

Accordingly, a frequency range is largest at a lowest lag among the lags of 147 through 171 corresponding to the autocorrelation range. When the lag is 147, the frequency range $FR_{COR}$ is calculated as shown in Formula (8).

$$FR_{COR} = \frac{22050}{147-0.5} \sim \frac{22050}{147+0.5} = 150.51 \sim 149.49 \quad (8)$$

Accordingly, when the lag is 147 through 171 on the above conditions, the frequency range $FR_{COR}$ at which the result of performing autocorrelation on the digital signal has a maximum error is (150.51~ 149.49) Hz, and the error range R2 for the result of autocorrelation is 1.02 Hz (150.51–149.49) based on the frequency range $FR_{COR}$.

In other words, the error range R2 (1.02 Hz) for the result of autocorrelation is less than the error range R1 (21.53 Hz) for the result of frequency transformation. Accordingly, in this case, a pitch is detected using autocorrelation.

When the error range R2 for the result of autocorrelation is greater than the error range R1 for the result of frequency transformation, the result of frequency transformation is determined as a pitch without performing autocorrelation. In other words, a pitch frequency is determined within the error range R1 for the result of frequency transformation.

The values used in the above description may be calculated in real time whenever pitch detection is required in response to the input of new sound or may be calculated based on a predetermined sampling rate and FFT window size and stored in a special storage unit in advance.

FIGS. 3A through 3D are signal processing diagrams for explaining the 2-phase pitch detection method according to the embodiment of the present invention.

Figure 3A:
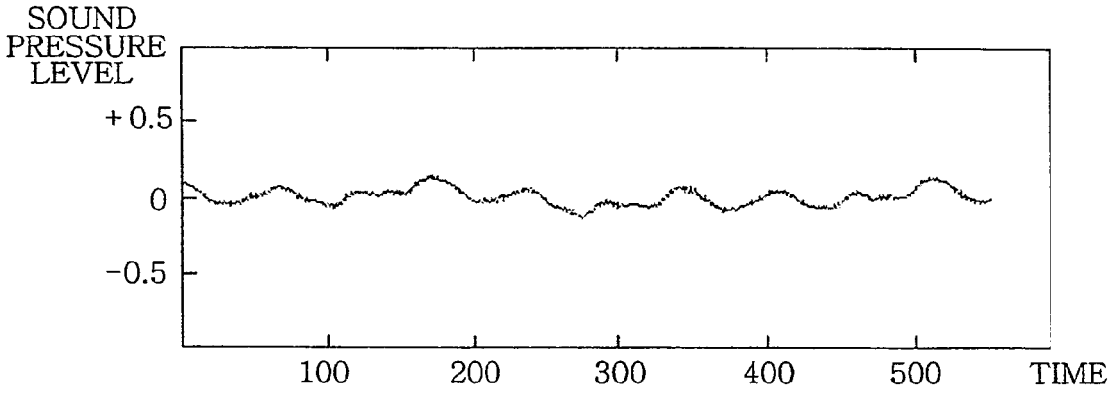
FIGS. 3A through 3D are signal processing diagrams for explaining the 2-phase pitch detection method according to the embodiment of the present invention.
Figure 3B:
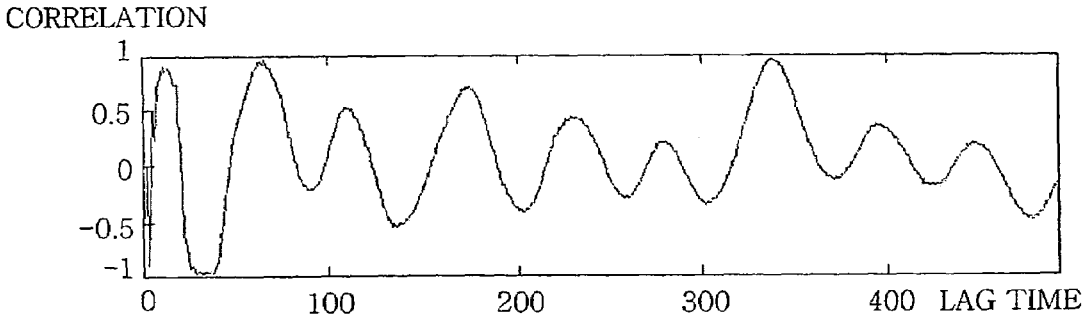
Figure 3C:
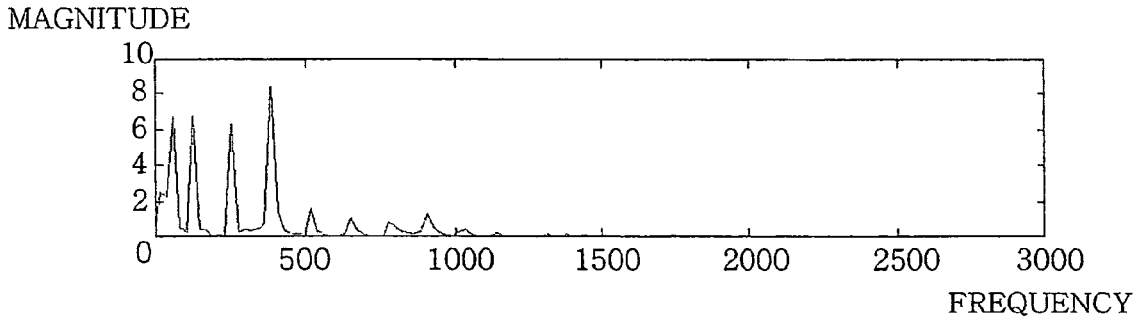
Figure 3D:
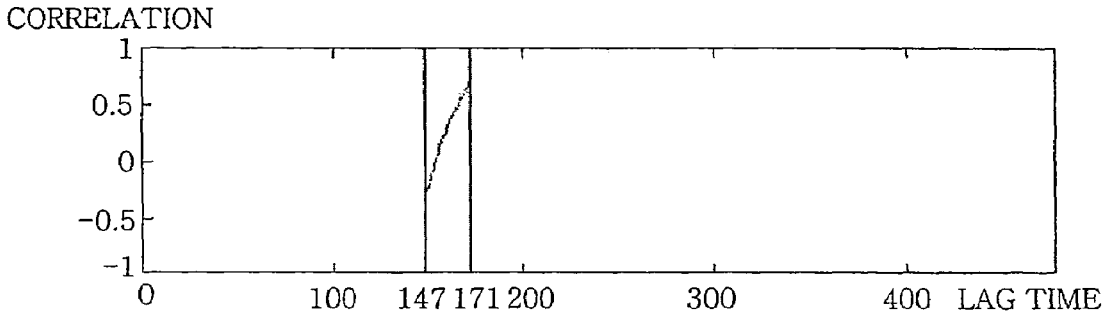

FIG. 3A shows an externally input waveform. FIG. 3B shows the result of performing autocorrelation on the waveform shown in FIG. 3A. FIG. 3C shows the result of performing frequency analysis on the waveform shown in FIG. 3A. FIG. 3D shows the result of autocorrelation in an autocorrelation range, which is determined based on the result of performing frequency analysis on the waveform shown in FIG. 3A.

FIG. 3B shows the entire result of performing autocorrelation on the externally input waveform shown in FIG. 3A. Referring to FIG. 3B, a pitch is erroneously detected at a maximum peak in a range of lag time of 0~100 or 300~400 although a maximum peak in a range of lag time of 100~200 is an actual pitch.

FIG. 3C shows the result of performing frequency analysis on the externally input waveform. Referring to FIG. 3C, although a second peak is an actual pitch, a fourth peak, i.e., the secondary harmonic frequency of the actual pitch, is erroneously detected as a pitch if a maximum frequency peak is selected. However, a method for detecting a pitch using frequency analysis is already known technology and can be performed in various ways. Therefore, we assume that second peak is correctly detected as an actual pitch in this example.

FIG. 3D shows the result of performing autocorrelation on an autocorrelation range, i.e., lag time, which is determined based on the result of frequency analysis according to the embodiment of the present invention. Here, an exact pitch can be detected.

Referring to FIGS. 3C and 3D, in the case of a note C3 on a piano, a maximum FFT index is 7, and an autocorrelation value is largest at a lag of 171. When the lag of 171 is applied to Formula (7), a frequency range is 128.57~129.32 Hz. In the meantime, according to Formula (3), a frequency range based on the result of performing FFT on the note C3 on the piano is 129.19~150.73 Hz. Accordingly, when the intersection between the frequency range for the result of FFT and the frequency range for the result of autocorrelation is obtained, a pitch is detected in a range of 129.19~129.32 Hz.

Here, the intersection between the frequency range for the result of FFT and the frequency range for the result of autocorrelation is obtained because a lag, which is referred to during the autocorrelation, is the maximum value of the lag range of 147~171.

In the above case, when considering that a basic frequency at the MIDI note C3 is 130.8 Hz, the piano is tuned a little lower. It is usual that a basic frequency of a note on a piano is a little different from a basic frequency of the MIDI note due to an error in tuning the piano. Accordingly, the present invention enables an exact pitch detection.

The above description just concerns embodiments of the present invention. The present invention is not restricted to the above embodiments, and various modifications can be made thereto within the scope defined by the attached claims. For example, the shape and structure of each member specified in the embodiments can be changed.

INDUSTRIAL APPLICABILITY

According to the present invention, after performing frequency analysis on an externally input digital signal, autocorrelation is selectively performed on the digital signal in a time range selected according to the result of frequency analysis, thereby solving a problem of frequency analysis having a large error range in detecting a pitch in a low-frequency band and a problem of autocorrelation having a large error range in detecting a pitch in a high-frequency band. Therefore, the present invention provides an effect of detecting an exact pitch.

In addition, instead of calculating autocorrelation coefficients with respect to an entire digital signal of a sample size and comparing the autocorrelation coefficients during autocorrelation, autocorrelation coefficients with respect to a digital signal in a time range selected according to the result of frequency analysis are calculated and compared. Accordingly, time taken to calculate autocorrelation coefficients and obtain the maximum autocorrelation coefficient can be reduced.

What is claimed is:

1. A 2-phase pitch detection method comprising:

a first step of analyzing an externally input digital signal into frequency components and detecting a first pitch candidate based on the frequency components;

a second step of comparing an error range for the first pitch candidate with an error range for the result of performing autocorrelation on an autocorrelation range, which is calculated using the error range for the first pitch candidate; and a third step of performing autocorrelation on the digital signal in a predetermined time range when the error range for the result of autocorrelation is less than or equal to the error range for the first pitch candidate, thereby detecting a pitch.

2. The 2-phase pitch detection method of claim 1, wherein the second step comprises the steps of:

(2-1) calculating the error range for the first pitch candidate;

(2—2) calculating the autocorrelation range with respect to the digital signal using the error range for the first pitch candidate;

(2-3) calculating the error range for the result of performing autocorrelation on the autocorrelation range; and (2-4) comparing the error range for the first pitch candidate with the error range for the result of autocorrelation.

3. The 2-phase pitch detection method of claim 1, wherein in the second step, the error range for the first pitch candidate, the autocorrelation range, and the error range for the result of autocorrelation are detected from information which has been calculated and separately stored in advance.

4. The 2-phase pitch detection method of claim 1, wherein the third step comprises the steps of:

(3-1) performing autocorrelation on the digital signal in the predetermined time range, which is determined in accordance with the autocorrelation range calculated in the second step;

(3-2) detecting a lag at which an autocorrelation coefficient is largest as the result of performing the autocorrelation; and (3—3) detecting a second pitch candidate for the digital signal using the lag and detecting a pitch from the second pitch candidate.

5. The 2-phase pitch detection method of claim 4, wherein step (3-1) comprises changing the time range for the autocorrelation of the digital signal within a predetermined range.

6. The 2-phase pitch detection method of claim 4, wherein step (3—3) comprises:

determining a pitch within an intersection between an error range for the second pitch candidate and the error range for the first pitch candidate when the lag detected in step (3-2) is a maximum or minimum value of the autocorrelation range calculated in the second step; and determining a pitch within the error range for the second pitch candidate when the lag detected in step (3-2) is not a maximum or minimum value of the autocorrelation range calculated in the second step.

7. The 2-phase pitch detection method of claim 1, wherein in the third step, when the error range for the result of autocorrelation is larger than the error range for the first pitch candidate, a pitch is determined within the error range for the first pitch candidate.

8. A 2-phase pitch detection apparatus comprising:

a frequency analyzer for analyzing an externally input digital signal into frequency components and detecting a first pitch candidate based on the frequency components;

an error range comparator for comparing an error range for the first pitch candidate with an error range for the result of performing autocorrelation on an autocorrelation range, which is calculated using the error range for the first pitch candidate;

an autocorrelation calculator for performing autocorrelation on the digital signal in a predetermined time range when the error range for the result of autocorrelation is less than or equal to the error range for the first pitch candidate in order to detecting a second pitch candidate;

a pitch determiner for determining a pitch based on the error range for the first pitch candidate and an error range for the second pitch candidate; and a result output unit for outputting the pitch determined by the pitch determiner.

9. The 2-phase pitch detection apparatus of claim 8, wherein the error range comparator detects the error range for the first pitch candidate, the autocorrelation range, and the error range for the result of autocorrelation from information which has been calculated and separately stored in advance.

10. The 2-phase pitch detection apparatus of claim 8, wherein the autocorrelation calculator performs autocorrelation on the digital signal in the predetermined time range, which is determined in accordance with the autocorrelation range calculated by the error range comparator, to detect a lag at which an autocorrelation coefficient is largest; and detects the second pitch candidate for the digital signal using the lag.

11. The 2-phase pitch detection apparatus of claim 10, wherein the autocorrelation calculator changes the autocorrelation range for the digital signal within a predetermined range.

12. The 2-phase pitch detection apparatus of claim 8, wherein the pitch determiner determines the pitch based on the first and second pitch candidates when the error range for the result of autocorrelation is less than or equal to the error range for the first pitch candidate as the result of comparison performed by the error range comparator; and determines the pitch within the error range for the first pitch candidate when the error range for the result of autocorrelation is larger than the error range for the first pitch candidate as the result of comparison performed by the error range comparator.

13. The 2-phase pitch detection apparatus of claim 8, wherein the pitch determiner:

determines the pitch within an intersection between the error range for the second pitch candidate and the error range for the first pitch candidate when the lag at which the autocorrelation is largest is the maximum or minimum value of the autocorrelation range calculated by the error range comparator; and determines the pitch within the error range for the second pitch candidate when the lag is not the maximum or minimum value of the autocorrelation range.

* * * * *